US011725461B2

(12) United States Patent
Garcia et al.

(10) Patent No.: US 11,725,461 B2
(45) Date of Patent: Aug. 15, 2023

(54) PERMANENTLY INSTALLED IN-WELL DRY MATE CONNECTORS WITH SHAPE MEMORY ALLOY TECHNOLOGY

(71) Applicant: Schlumberger Technology Corporation, Sugar Land, TX (US)

(72) Inventors: Jean-Luc Garcia, Clamart (FR); Yann Dufour, Houston, TX (US); Steve Watelle, Clamart (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 8 days.

(21) Appl. No.: 17/288,131

(22) PCT Filed: Oct. 25, 2019

(86) PCT No.: PCT/US2019/058142
§ 371 (c)(1),
(2) Date: Apr. 23, 2021

(87) PCT Pub. No.: WO2020/087001
PCT Pub. Date: Apr. 30, 2020

(65) Prior Publication Data

US 2021/0381321 A1 Dec. 9, 2021

Related U.S. Application Data

(60) Provisional application No. 62/751,265, filed on Oct. 26, 2018.

(51) Int. Cl.
*E21B 17/02* (2006.01)

(52) U.S. Cl.
CPC ..... *E21B 17/028* (2013.01)

(58) Field of Classification Search
CPC ..... E21B 17/0285; E21B 17/028
See application file for complete search history.

(56) References Cited

U.S. PATENT DOCUMENTS 4,204,739 A * 5/1980 Shoenleben ..... E21B 17/028 439/805
4,352,542 A 10/1982 Tydings
(Continued)

FOREIGN PATENT DOCUMENTS

WO 2008034762 A1 3/2008
WO 2014084826 A1 6/2014
(Continued)

OTHER PUBLICATIONS

International search Report and Written Opinion issued in the PCT Application PCT/US2021/061188, dated Mar. 21, 2022 (10 pages).
(Continued)

*Primary Examiner* — D. Andrews
(74) *Attorney, Agent, or Firm* — Jeffrey D. Frantz

(57) ABSTRACT

A technique facilitates formation of secure connections for use in downhole environments. According to an embodiment, a connector may be constructed as a dry mate connector which provides both a sealed connection and a connection able to withstand a predetermined tensile loading. The connector comprises connector ends combined with an outer connector housing. Additionally, the connector comprises a shape memory alloy sealing system which may be activated to form a secure seal with a corresponding cable or other component feature. The connector also comprises a shape memory alloy retainer system which may be activated to securely grip the corresponding cable or other component feature so as to withstand substantial tensile loading acting on the corresponding cable or other component feature.

19 Claims, 3 Drawing Sheets

(56) References Cited

U.S. PATENT DOCUMENTS

| | | | | |
|---|---|---|---|---|
| 4,773,680 | A | 9/1988 | Krumme | |
| 4,880,343 | A | 11/1989 | Matsumoto | |
| 5,478,970 | A * | 12/1995 | Lawler | E21B 17/023 174/77 R |
| 5,714,738 | A * | 2/1998 | Hauschulz | H05B 3/58 219/535 |
| 9,000,296 | B2 | 4/2015 | Mueller et al. | |
| 9,071,008 | B2 | 6/2015 | Zillinger et al. | |
| 9,722,400 | B2 | 8/2017 | Koppe et al. | |
| 9,771,791 | B2 | 9/2017 | Schulz et al. | |
| 2003/0111796 | A1* | 6/2003 | Kohli | E21B 47/017 277/322 |
| 2010/0006303 | A1 | 1/2010 | Garcia et al. | |
| 2014/0374167 | A1* | 12/2014 | Mueller | E21B 17/003 175/308 |
| 2016/0076312 | A1 | 3/2016 | Fraczek et al. | |

FOREIGN PATENT DOCUMENTS

| | | | |
|---|---|---|---|
| WO | 2019222823 | A1 | 11/2019 |
| WO | 2022115780 | A1 | 6/2022 |

OTHER PUBLICATIONS

International Search Report and Written Opinion issued in the PCT Application PCT/US2019/058142 dated Feb. 12, 2020 (13 pages).

Hydraulic Dry Mate Connector (2016) at https://www.slb.com/-/media/files/co/product-sheet/wellwatcher-hydraulic-dry-mate-connector-ps.ashx, (1 page, downloaded on Apr. 23, 2021).

Intellitite (2014) at https://www.slb.com/-/media/files/co/product-sheet/intellitite-edmc-ps.ashxEDMC-R (1 page, downloaded on Apr. 23, 2021).

* cited by examiner

PERMANENTLY INSTALLED IN-WELL DRY MATE CONNECTORS WITH SHAPE MEMORY ALLOY TECHNOLOGY

CROSS-REFERENCE TO RELATED APPLICATIONS

Any and all applications for which a foreign or domestic priority claim is identified in the Application Data Sheet as filed with the present application are hereby incorporated by reference under 37 CFR 1.57. The present application claims priority benefit of U.S. Provisional Application No. 62/751,265, filed Oct. 26, 2018, the entirety of which is incorporated by reference herein and should be considered part of this specification.

BACKGROUND

Description of the Related Art

In many well applications, electrical connectors are used to connect various components which are utilized in a downhole environment. For example, connections may be made between sections of electrical cable, between an electrical cable and a downhole component, e.g. sensor, or between other downhole components. In some downhole applications, dry mate connectors may be permanently installed to form, for example, a cable splice between sections of cable or between a device and a corresponding cable. However, difficulties can arise in forming a connection/splice which is able to remain sealed with respect to the surrounding environment while also withstanding tensile loading, e.g. tensile loading occurring during tensile load testing.

SUMMARY

In general, a system and methodology are provided for forming secure connections for use in downhole environments. According to an embodiment, a connector may be constructed as a dry mate connector that provides both a sealed connection and a connection able to withstand a predetermined tensile loading. The connector comprises connector ends combined with an outer connector housing. Additionally, the connector can comprise a shape memory alloy sealing system, which may be activated to form a secure seal with a corresponding cable or other component feature. The connector can also comprise a shape memory alloy retainer system, which may be activated to securely grip the corresponding cable or other component feature so as to withstand substantial tensile loading acting on the corresponding cable or other component feature.

However, many modifications are possible without materially departing from the teachings of this disclosure. Accordingly, such modifications are intended to be included within the scope of this disclosure as defined in the claims.

BRIEF DESCRIPTION OF THE FIGURES

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
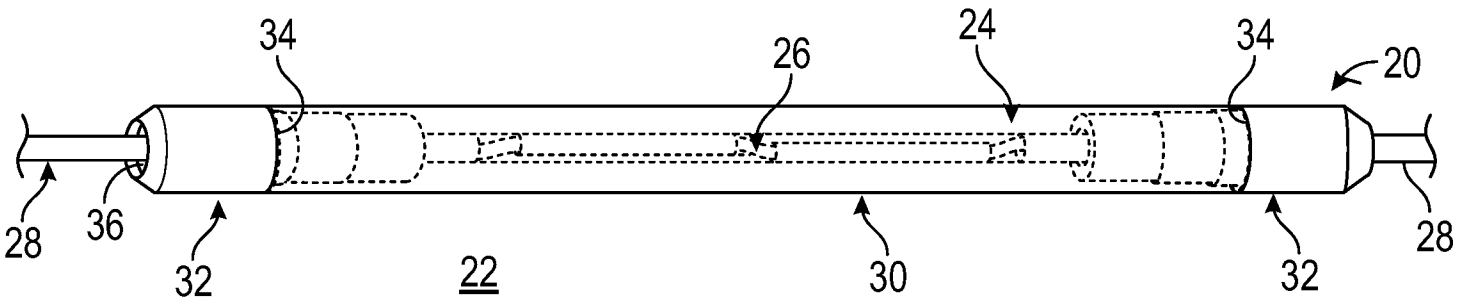
FIG. 1 is an illustration of an example of a connector connecting two components, e.g., two sections of permanent downhole cable, via a shape memory alloy sealing system and a shape memory alloy retainer system, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology for forming secure connections for use in downhole environments. According to some embodiments, a connector may be constructed as a dry mate connector that provides both a sealed connection and a connection able to withstand a predetermined tensile loading. The dry mate connector may be in the form of an electrical dry mate connector that forms a sealed, electrical connection along a permanent downhole cable. The permanent downhole cable may be employed along, for example, a well completion system.

According to an embodiment, the connector comprises connector ends combined with an outer connector housing. Additionally, the connector comprises a shape memory alloy sealing system which may be positioned within the outer housing. The shape memory alloy sealing system is activated to form a secure seal with a corresponding cable or other component feature. The connector also comprises a separate shape memory alloy retainer system which may be activated to securely grip the corresponding cable or other component feature. The secure gripping enables the connector to withstand substantial tensile loading acting on the corresponding cable or other component feature.

Activation of the shape memory materials forming the sealing system and the retainer system may be achieved via a suitable change in temperature, e.g. sufficient heating, or via other suitable activation techniques. The particular activation technique selected depends on the type of shape memory material employed. In a variety of applications, the shape memory material may be in the form of a shape memory metal alloy, e.g. a nickel-titanium alloy which is heat activated.

According to one embodiment, the shape memory alloy sealing system may comprise seal teeth formed of the shape memory alloy. The seal teeth engage and seal against the outside of the corresponding cable (or other component feature) upon activation of the shape memory alloy so as to form a seal which prevents fluid from running along the outside of the cable. In some applications, the cable may be coupled with a sensor system, e.g. a gauge, via the connector. Activation of the shape memory alloy sealing system prevents fluid from running along the outside of the cable and getting into the gauge.

Additionally, the shape memory alloy retainer system may be formed in the shape of a ring or a plurality of rings which clamp down on the corresponding cable (or other component feature) upon activation of the shape memory alloy. The structure of the connector and the utilization of shape memory material for both sealing and retention enables construction of a relatively inexpensive connector which can be installed in a reduced amount of time.

In some embodiments, at least portions of the connector may be preassembled so as to facilitate easier installation in the field with a reduced chance for making mistakes during the installation process. Consequently, the connector can provide reliability gains relative to conventional connectors used in downhole environments and applications.

Referring generally to FIG. 1, an example of a connector 20 is illustrated as deployed in a downhole environment 22, e.g. a wellbore environment. In this example, the connector 20 is a dry mate type connector having a dry, e.g., air-filled, interior 24 for containing a coupling 26, e.g., a cable splice of two sections of a cable 28. According to the illustrated embodiment, the connector 20 comprises an external housing 30 coupled with a pair of coupler ends 32 so as to enclose the interior 24 and the coupling 26. The coupler ends 32 may be secured to the external housing 30 via weldments 34 or other suitable coupling techniques, e.g., threaded engagement combined with seals.

The sections of cable 28 extend through the coupler ends 32 and into the interior 24 once the connector 20 is properly placed around the coupling 26. In the particular example illustrated, the connector 20 is used to provide a sealed connection of two permanent electrical cable sections of cable 28. Cable 28 may be a permanent downhole cable for use in downhole applications, e.g. a downhole wellbore application. In such applications, the connector 20 may serve as a permanently installed in-well dry mate connector. It should be noted the sections of cable 28 may comprise a variety of cables having different types and numbers of conductors located therein. By way of example, the sections of cable 28 may comprise mono-cables, twisted pair type cables, or cables having additional conductors, e.g., 4-wire cables, spliced together at coupling 26.

For some applications, qualifying the connector 20 and corresponding connected sections of cable 28 involves tensile testing. As explained in greater detail below, however, the shape memory alloy retainer system is readily able to handle the tensile loading associated with testing. The retainer system may be constructed to protect against slippage of the sections of cable 28 relative to connector 20 when the cable 28 and connector 20 are exposed to a variety of relatively large tensile forces.

Figure 2:
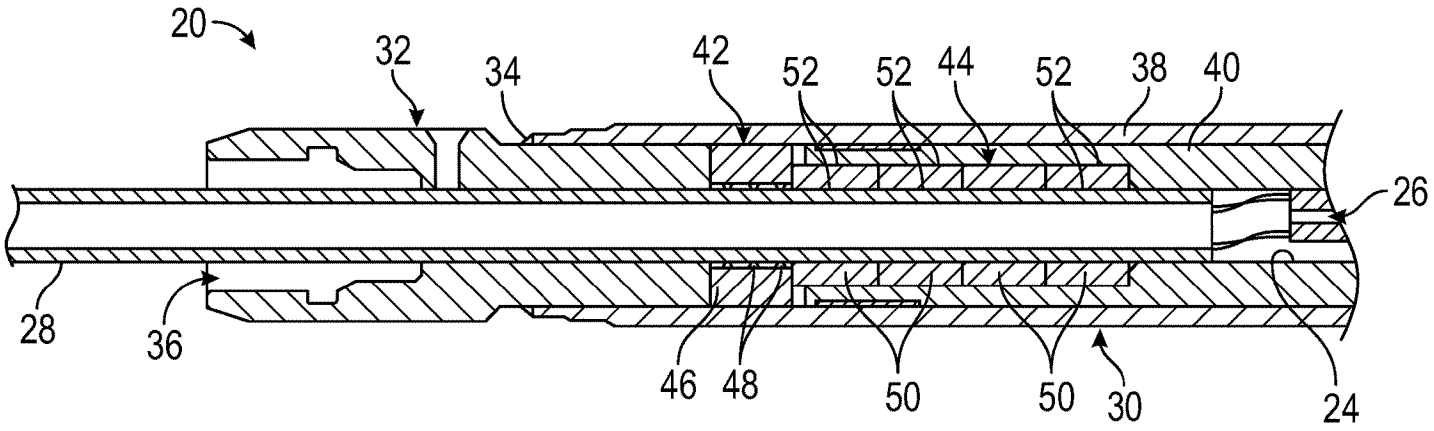
FIG. 2 is a cross-sectional illustration of a portion of the connector illustrated in FIG. 1, according to an embodiment of the disclosure.

Referring generally to FIG. 2, the left side of connector 20 is illustrated in cross-section to facilitate explanation of the use of shape memory alloy materials. In this example, the left coupler end 32 is illustrated as having a passage 36 extending therethrough and sized to receive the corresponding section of electrical cable 28. The corresponding section of electrical cable 28 extends through the passage 36 and into interior 24 for coupling with the adjacent section of electrical cable 28 via coupling 26.

In this example, the external housing 30 comprises an outer housing section 38 combined with an inner housing or subsection 40 disposed along the interior of outer housing section 38. The connector 20 also comprises a sealing system 42 formed of a shape memory material, e.g., a shape memory alloy, disposed between the corresponding section of electrical cable 28 and the external housing 30. Additionally, the connector 20 comprises a retainer system 44 formed of a shape memory material, e.g., a shape memory alloy, disposed between the corresponding section of electrical cable 28 and the external housing 30. The shape memory alloy may be a metal alloy, such as available shape memory metal alloys formed of nickel and titanium.

By way of example, the sealing system 42 may be in the form of a ring clamp 46 having internal sealing teeth 48. The ring clamp 46 and the internal sealing teeth 48 may be formed of the shape memory alloy material. However, in some embodiments, the ring clamp 46 may be constructed of the shape memory alloy material and the sealing teeth 48 may be constructed of a different type of material.

The ring clamp 46 is disposed around the corresponding section of electrical cable 28 such that the sealing teeth 48 are oriented towards the electrical cable 28. In this embodiment, the ring clamp 46 is captured between electrical cable 28 and outer housing section 38 and is bounded axially by the corresponding coupler end 32 and inner housing 40, as illustrated. In some embodiments, a plurality of the ring clamps 46 may be used. The ring clamp(s) 46 are generally positioned proximate each coupler end 32 to form a seal on each side of coupling 26.

Regardless of the number of ring clamps 46, activation of the shape memory alloy sealing system, e.g., sufficient heating of the shape memory alloy material, causes the ring clamp(s) 46 to transition to an original configuration. For example, the ring clamp(s) 46 may expand to force the sealing teeth 48 in a radially inward direction. This transition forces the sealing teeth 48 radially inward until they are moved into sealing engagement with the exterior of the electrical cable 28.

In the embodiment illustrated, the retainer system 44 may be formed of a retainer ring or a plurality of retainer rings 50 which are positioned between housing 30 and electrical cable 28. By way of example, the retainer ring(s) 50 may be positioned between a wall of inner housing 40 and the electrical cable 28. The retainer ring(s) 50 may similarly be formed of a suitable shape memory material, e.g., a shape memory alloy material, which can be activated via application of sufficient heat or via other suitable method of activation. Retainer rings 50 are generally positioned proximate each coupler end 32 to form a gripping engagement with the corresponding section of electrical cable 28 on each side of coupling 26.

Each retainer ring 50 also may comprise internal and/or external gripping surfaces 52, e.g., surfaces with teeth, knurling, or other features to facilitate gripping of both housing 30 and the corresponding section of electrical cable 28 upon activation of the shape memory alloy material. In some embodiments, the external gripping surfaces 52 may be formed via intermediate mechanical rings or devices located between the shape memory alloy rings 50 and the electrical cable 28. The gripping surfaces 52 help increase the tensile load which can be applied to the coupled electrical cable 28 before slippage occurs. It should be noted the ring or rings 50 also may be positioned at other appropriate locations to help reduce the potential for slippage.

With respect to the rings 50, activation of their shape memory material, e.g. application of sufficient heating to the shape memory alloy material, causes the retainer rings 50 to transition to an original configuration. For example, the retainer rings 50 may expand to force the gripping surfaces 52 in radial directions against the interior surface of inner housing 40 and against the exterior of electrical cable 28.

This transition securely grips the electrical cable 28 with respect to coupler housing 30 to prevent the undesired slippage when the connector 20/cable 28 is exposed to tensile loading.

Figure 3:
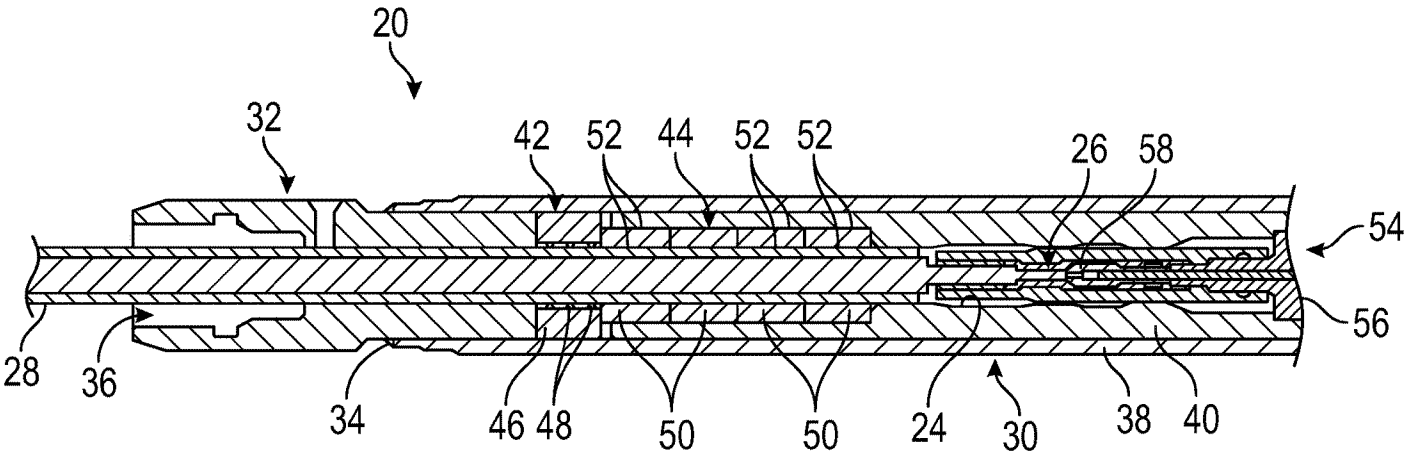
FIG. 3 is a cross-sectional illustration of another embodiment of a connector for connecting components utilized in a downhole environment, according to an embodiment of the disclosure.

Referring generally to FIG. 3, another embodiment of connector 20 is illustrated. In this embodiment, many of the components are the same or similar and have been labeled with common reference numerals. In this particular application, however, a section of the electrical cable 28 is coupled, via connector 20, with another type of device 54.

According to the illustrated embodiment, the device 54 is in the form of a gauge 56 which is electrically coupled with electrical cable 28 at coupling 26 via a gauge electrical connector 58. However, device 54 may comprise other types of devices which may be coupled to electrical cable 28 via connector 20. In many of these applications, the connector 20 may be used to form a permanent, sealed connection, with substantial resistance to tensile loading.

Figure 4:
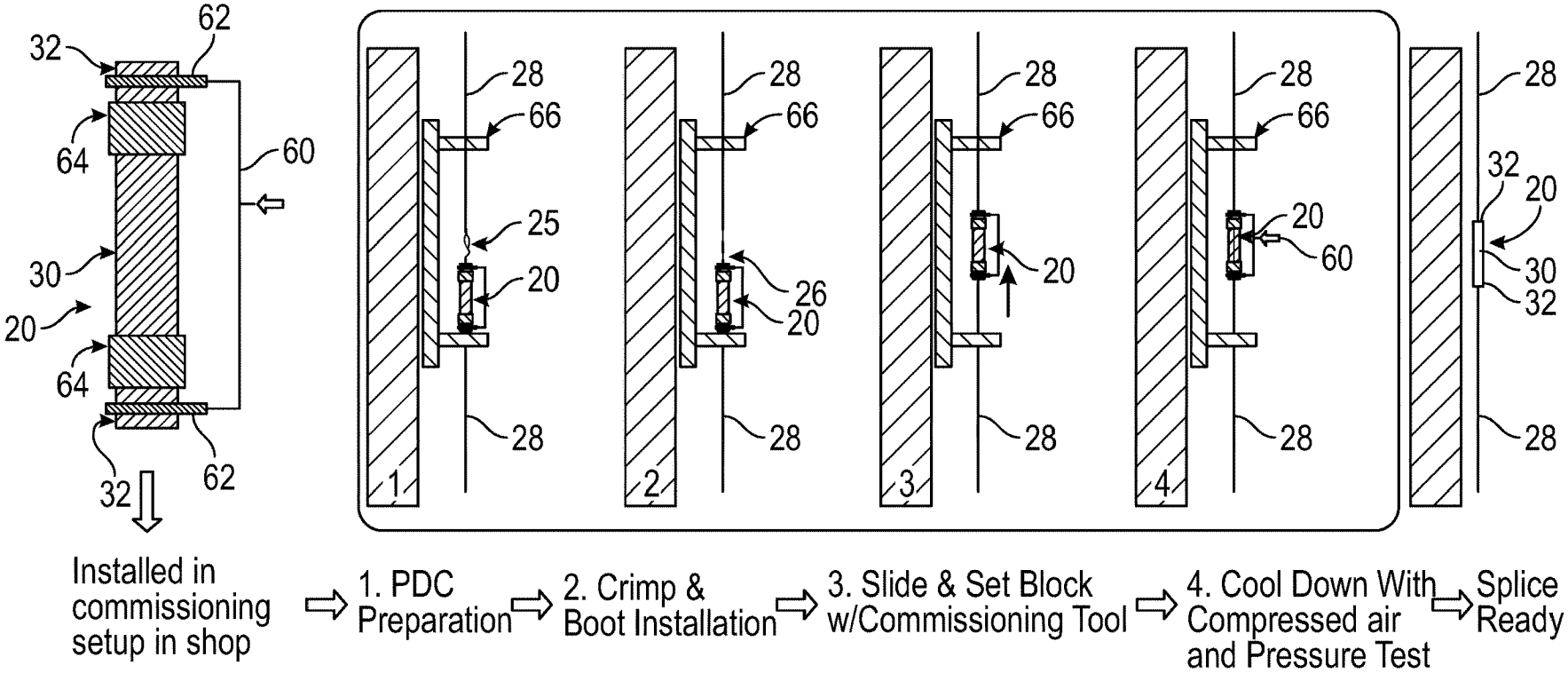
FIG. 4 is an illustration showing an example of a connector installation procedure which may be used in the field or at another suitable location, according to an embodiment of the disclosure.

Referring generally to FIG. 4, an illustration is provided of a field installation method for utilizing connector 20 in joining sections of electrical cable 28. In this example, electrical cable 28 may be in the form of permanent downhole cable (PDC). As illustrated, the connector 20 may be combined with a pressure test line 60 linked with the connector 20 via pressure couplers 62. Additionally, heating collars 64 may be positioned about external housing 30 of connector 20 proximate coupler ends 32 to facilitate application of heat in a manner which activates the shape memory alloy material of the sealing system 42 and the retainer system 44.

Initially, the sections of electrical cable 28 are mounted in an installation jig 66. The connector 20 is then slid onto one section of the electrical cable 28 and the conductors, e.g. wires 25, of the two sections of electrical cable 28 are placed in proximity to each other (see configuration 1). The wires/conductors are then joined to form coupling 26 via, for example, a crimp and boot installation or splice (see configuration 2).

At this stage, the connector 20 may be slid over the coupling 26 and heat may be applied to the connector 20 via a heating tool or by heating the surrounding environment (see configuration 3). The heating activates the sealing system 42 and the retainer system 44 to both seal the connector 20 and retain the sections of electrical cable 28 in a joined configuration by resisting tensile loading. For example, the application of heat may be used to cause the ring clamps 46 and the retainer rings 50 to transition to original, radially expanded configurations which securely seal and grip the sections of electrical cable 28. At this stage, the connector 20 may be cooled via compressed air or other suitable cooling technique and pressure tested via pressure test line 60 to ensure the splice is completed and ready for use in a downhole environment (see configuration 4).

Depending on the environment and parameters of a given operation, the connector 20 may be constructed in various configurations and sizes. The sealing system and retainer system may be constructed from individual rings, a plurality of rings, or from other suitable structures able to achieve the desired sealing and gripping functionality on both sides of coupling 26. The shape memory material may be constructed from various metal alloys which are able to transition to another desired shape upon activation. Depending on the type of shape memory material, the activation technique may involve application of different levels of heat for appropriate time periods. Other types of materials may be activated via other suitable techniques.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, the system comprising:

a pair of electrical cable sections joined via a coupling to form an electrical cable; and a connector, the connector comprising:

an external housing joined directly to a pair of coupler ends, each coupler end being combined with a sealing system and a separate retainer system, wherein the external housing joined to the pair of coupler ends combined with the sealing system and the separate retainer system is configured to slide over the coupling;

the sealing system, wherein the sealing system is:

formed at least in part of a shape memory alloy material selectively activatable to seal against the pair of electrical cable sections, bound radially between the external housing and the electrical cable sections, the sealing system being adjacent to the external housing and the electrical cable sections, and bound axially between the coupler end and an inner housing of the connector, the sealing system being adjacent to the coupler end and the inner housing;

the separate retainer system, wherein the separate retainer system is formed at least in part of the shape memory alloy material selectively activatable to grip the pair of electrical cable sections; and the inner housing, wherein the inner housing substantially encloses the separate retainer system.

2. The system as recited in claim 1, wherein the shape memory alloy material is a metal alloy material activatable via application of heat.

3. The system as recited in claim 1, wherein the sealing system comprises a ring clamp having internal sealing teeth oriented towards one of the electrical cable sections, and wherein when the sealing system is activated the ring clamp expands and forces the internal sealing teeth radially inward to seal against the pair of electrical cable sections.

4. The system as recited in claim 3, wherein the separate retainer system comprises a plurality of retainer rings, wherein the separate retainer system is bound radially between the inner housing and the electrical cable sections, and wherein the separate retainer system is further bound axially between the sealing system and the inner housing, the separate retainer system being adjacent to the inner housing, the sealing system, and the electrical cable sections.

5. The system as recited in claim 4, wherein each retainer ring, of the plurality of retainer rings, comprises internal and external gripping surfaces.

6. The system as recited in claim 1, wherein the separate retainer system comprises a plurality of retainer rings.

7. The system as recited in claim 1, wherein the connector is a dry mate type connector.

8. The system as recited in claim 1, wherein the coupler ends are secured to the external housing via weldments.

9. A method for coupling components employed in a downhole environment, comprising:

providing a connector with a sealing system and a retainer system each formed of a shape memory alloy material;

mounting sections of an electrical cable in an installation jig;

positioning the connector onto one section of the electrical cable and joining conductor wires of the sections of the electrical cable to form a coupling;

sliding the connector, with the sealing system and the retainer system, over the coupling; and applying heat to the connector to activate the shape memory alloy material of the sealing system and of the retainer system to form a sealed connection with each section of the electrical cable able to withstand a predetermined tensile loading.

10. The method as recited in claim 9, further comprising forming the sealing system in the form of a ring clamp.

11. The method as recited in claim 10, wherein forming the sealing system comprises locating sealing teeth along an interior surface of the ring clamp.

12. The method as recited in claim 10, further comprising forming the retainer system with a retainer ring having internal and external gripping surfaces.

13. The method as recited in claim 10, further comprising forming the retainer system with a plurality of retainer rings, each retainer ring having internal and external gripping surfaces.

14. The method as recited in claim 13, further comprising deploying the electrical cable and the connector downhole into a wellbore.

15. The method as recited in claim 13, wherein applying heat comprises applying heat to heating collars positioned adjacent the shape memory alloy material.

16. The method as recited in claim 13, further comprising performing a pressure test of the connector via a pressure test line.

17. A system for use in a borehole, comprising:

a connector for connecting a section of electrical cable with an electrical component, the connector comprising:

an external housing joined directly to a pair of coupler ends, each coupler end working in cooperation with:

a sealing system having a ring clamp formed of shape memory alloy material, the shape memory alloy material being selectively activatable to form a sealed connection between the electrical cable and electrical component, wherein the sealing system is bound axially between the coupler end and an inner housing of the connector, the sealing system being adjacent to the coupler end and the inner housing;

a separate retainer system having a retainer ring formed of shape memory alloy material, the shape memory alloy material being selectively activatable to protect the sealed connection against detrimental effects of axial loading, wherein the external housing is configured to slide over a coupling of electrical cable sections; and the inner housing, wherein the inner housing substantially encloses the separate retainer system.

18. The system as recited in claim 17, wherein the electrical component comprises another section of electrical cable.

19. The system as recited in claim 17, wherein the electrical component comprises a downhole gauge.

* * * * *